US011535345B2

(12) United States Patent
Hooper et al.

(10) Patent No.: US 11,535,345 B2
(45) Date of Patent: Dec. 27, 2022

(54) PORTABLE UUV LAUNCH AND RECOVERY ASSEMBLY

(71) Applicant: United States of America as represented by the Secretary of the Navy, San Diego, CA (US)

(72) Inventors: Ralph David Hooper, Lemon Grove, CA (US); Jeffery Towns Gilchrist, Cardiff, CA (US); William A. Chambers, Jamul, CA (US); Taylor R. Doolittle, San Diego, CA (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 184 days.

(21) Appl. No.: 17/178,694

(22) Filed: Feb. 18, 2021

(65) Prior Publication Data

US 2022/0258841 A1 Aug. 18, 2022

(51) Int. Cl.

| | |
|---|---|
| ***B63B 35/42*** | (2006.01) |
| ***B63B 27/14*** | (2006.01) |
| ***B63B 27/08*** | (2006.01) |
| ***B63B 35/40*** | (2006.01) |

(52) U.S. Cl.

CPC ..... *B63B 35/42* (2013.01); *B63B 27/08* (2013.01); *B63B 27/143* (2013.01); *B63B 2035/405* (2013.01)

(58) Field of Classification Search

CPC ..... B63B 27/08; B63B 35/42; B63B 27/143; B63B 2027/165; B63B 2035/405

USPC ..... 114/259

See application file for complete search history.

(56) References Cited

U.S. PATENT DOCUMENTS

| | | | | |
|---|---|---|---|---|
| 3,937,163 | A * | 2/1976 | Rosenberg | B66C 13/02 114/259 |
| 6,779,475 | B1 * | 8/2004 | Crane | B63B 27/10 114/259 |
| 6,840,188 | B1 * | 1/2005 | Witbeck | B63B 27/36 114/259 |
| 7,063,033 | B1 * | 6/2006 | Jackson | B63C 1/02 114/259 |
| 8,234,992 | B1 * | 8/2012 | Patterson, Jr. | B63B 35/40 114/259 |
| 9,180,944 | B2 * | 11/2015 | Imel | B63C 3/02 |
| 10,220,916 | B2 * | 3/2019 | Hooper | B63B 35/40 |
| 11,148,769 | B2 * | 10/2021 | Childress | B63B 35/40 |

(Continued)

*Primary Examiner* — Daniel V Venne

(74) *Attorney, Agent, or Firm* — Naval Information Warfare Center, Pacific; Kyle Eppele; James McGee

(57) ABSTRACT

An apparatus and method transports, launches, and recovers an unmanned undersea vehicle (UUV) on a boat. A pair of support rails secures the UUV to the boat during the transport across a body of water on the boat. The support rails support the UUV in sliding movement along the support rails during the launch from the boat into the body of water and during the recovery from the body of water onto the boat. A ramp is deployed that extends the support rails into the body of water through a stern of the boat. The ramp includes a pair of alignment rails for aligning the UUV with the support rails during the recovery. A winch pulls the UUV out of the body of water during the recovery, with the winch pulling the UUV into the alignment rails and then onto the support rails in the boat.

20 Claims, 4 Drawing Sheets

(56) References Cited

U.S. PATENT DOCUMENTS

| | | | | |
|---|---|---|---|---|
| 11,235,845 | B2 * | 2/2022 | Jackson | B63C 1/04 |
| 11,352,106 | B2 * | 6/2022 | Childress | B63C 1/02 |

* cited by examiner

PORTABLE UUV LAUNCH AND RECOVERY ASSEMBLY

FEDERALLY-SPONSORED RESEARCH AND DEVELOPMENT

The United States Government has ownership rights in this invention. Licensing and technical inquiries may be directed to the Office of Research and Technical Applications, Naval Information Warfare Center Pacific, Code 72120, San Diego, Calif., 92152; voice (619) 553-5118; ssc_pac_t2@navy.mil. Reference Navy Case Number 111332.

BACKGROUND OF THE INVENTION

Providing a rapidly positioned worldwide capability for US Navy assets, including unmanned undersea vehicles, is a driving requirement of many operational systems. There is a general need for smaller, lighter, and more easily transported systems to increase operational agility and flexibility.

SUMMARY

An apparatus for transport, launch, and recovery of an unmanned undersea vehicle (UUV) includes a pair of support rails, a ramp, and a winch. The support rails secure the UUV to a boat during the transport across a body of water. The support rails support the UUV in sliding movement along the support rails during the launch from the boat into the body of water and during the recovery from the body of water onto the boat. The ramp extends the support rails into the body of water in a deployed state. The ramp includes a pair of alignment rails for aligning the UUV with the support rails in the deployed state during the recovery from the body of water. The winch pulls the UUV out of the body of water during the recovery, with the winch pulling the UUV into the alignment rails and then onto the support rails in the boat during the recovery.

A method transports, launches, and recovers an unmanned undersea vehicle (UUV) on a boat. The UUV is secured to a pair of support rails during the transport across a body of water on the boat. A ramp is deployed that includes a pair of alignment rails, and in a deployed state the alignment rails extend the support rails into the body of water through a stem of the boat. The UUV is supported in sliding movement along the support rails during the launch from the boat through the stem into the body of water. The UUV is pulled out of the body of water through the stern with a winch during the recovery, including pulling the UUV into the alignment rails that align the UUV with the support rails. The UUV is supported in sliding movement along the support rails during the recovery from the body of water onto the support rails in the boat.

BRIEF DESCRIPTION OF THE DRAWINGS

Throughout the several views, like elements are referenced using like references. The elements in the figures are not drawn to scale and some dimensions are exaggerated for clarity.

DETAILED DESCRIPTION OF EMBODIMENTS

The disclosed apparatus and method below may be described generally, as well as in terms of specific examples and/or specific embodiments. For instances where references are made to detailed examples and/or embodiments, it should be appreciated that any of the underlying principles described are not to be limited to a single embodiment, but may be expanded for use with any of the other methods and systems described herein as will be understood by one of ordinary skill in the art unless otherwise stated specifically.

An apparatus for transport, launch, and recovery of an unmanned undersea vehicle (UUV) is readily disassembled into an expeditionary package with a small size of less than 100 cubic feet and a low weight of 550 pounds either disassembled or assembled to be readily man portable and increase operational agility and flexibility.

Figure 1:
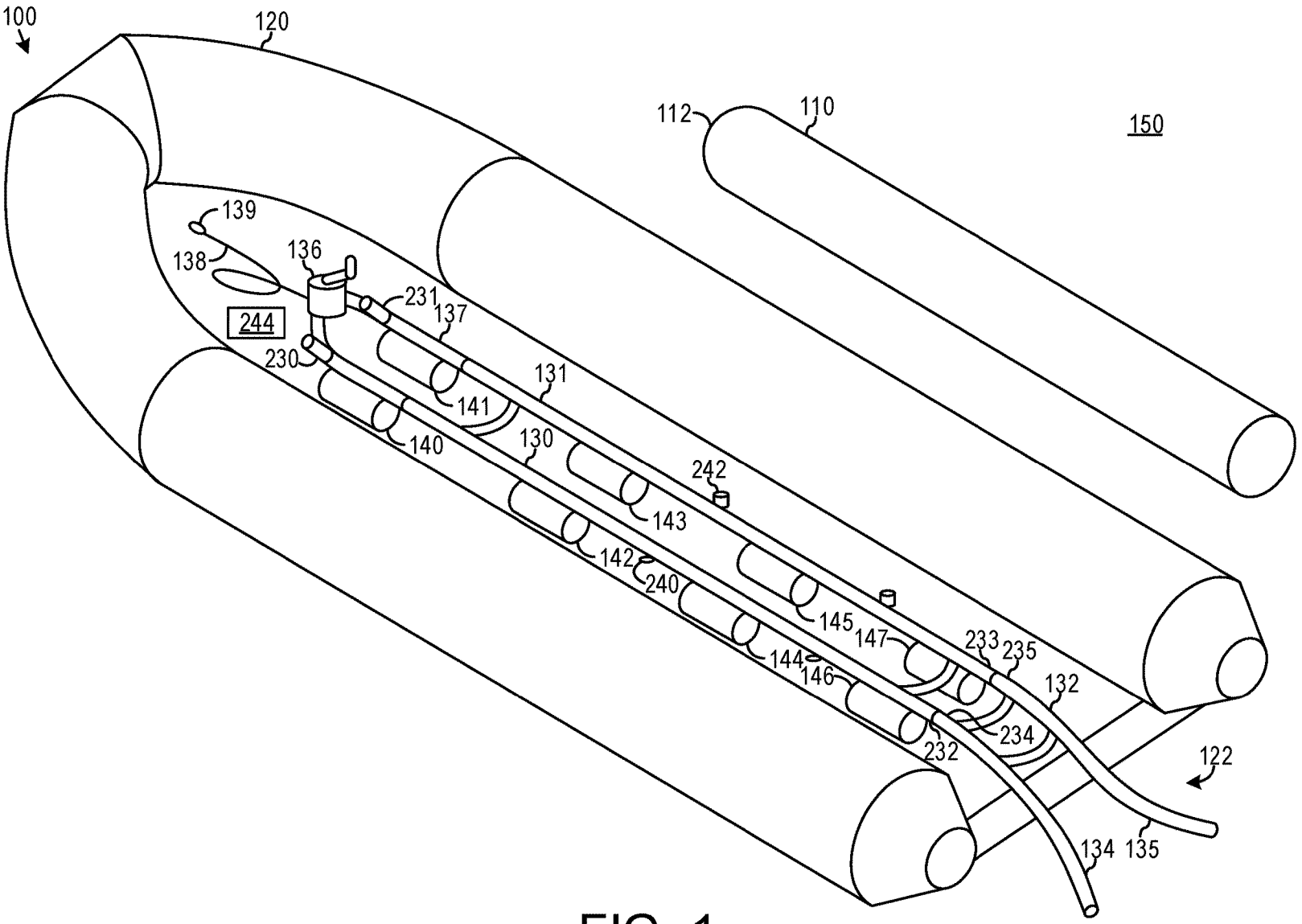
FIG. 1 is a perspective diagram showing an apparatus for transport, launch, and recovery of an unmanned undersea vehicle (UUV) on a boat when the apparatus is in a deployed state after launch or before recovery in accordance with an embodiment of the invention.

FIG. 1 is a perspective diagram showing an apparatus 100 for transport, launch, and recovery of an unmanned undersea vehicle (UUV) 110 on a boat 120 when the apparatus 100 is in a deployed state after launch or before recovery of the UUV 110 in accordance with an embodiment of the invention.

The apparatus 100 includes a pair of support rails 130 and 131, a ramp 132, and a winch 136. The support rails 130 and 131 support the UUV 110 in sliding movement along the support rails 130 and 131 during the launch of UUV 110 from the boat 120 into the body of water 150 and during the recovery from the body of water 150 onto the boat 120. The ramp 132 includes a pair of alignment rails 134 and 135 that extend the support rails 130 and 131 into the body of water 150 in the deployed state shown in FIG. 1. The ramp 132 aligns the UUV 110 with the support rails 130 and 131 during the recovery from the body of water 150. The winch 136 pulls the UUV 110 out of the body of water 150 during the recovery, with the winch 136 pulling the UUV 110 into the alignment rails 134 and 135 and then onto the support rails 130 and 131 in the boat 120 during the recovery.

In one embodiment, the apparatus 100 includes the boat 120 that is an inflatable boat without a transom at the stern 122 of the boat 120 so that, in the deployed state during the launch and the recovery, the alignment rails 134 and 135 of the ramp 132 extend through the stern 122 of the inflatable boat 120. Besides the atypical lack of a transom, the inflatable boat 120 has an atypically high aspect ratio of length over width to enhance its towing speed over the body of water 150 without overly sacrificing stability. The inflatable boat 120 is collapsible and the pair of support rails 130 and 131, the ramp 132, and a cross member 137 carrying the winch 136 are detachable from each other to produce a disassembly with a combined maximum length of 104 inches so that the disassembly including the boat 120 is expeditionary to fit on a single aircraft pallet.

As shown in the embodiment of FIG. 1, the alignment rails 134 and 135 of the ramp 132 are a pair of flaring curved rails that align the UUV 110 with the parallel support rails 130 and 131 during the launch and during the recovery despite waves and turbulence of the body of water 150, such as an ocean, sea, lake, or river.

The winch 136 is disposed on a cross member 137 that bridges between the support rails 130 and 131 at a fore end of the support rails 130 and 131. The winch 136 is a hand winch drawing a line 138 terminating at a carabiner 139 for attaching to a nose 112 of the UUV 110 for pulling the UUV 110 out of the body of water 150 and onto the boat 120 during the recovery. During recovery, the boat 120 is maneuvered alongside the UUV 110, by maneuvering the boat 120 or operating the UUV 110 or both, and then the carabiner 139 is attached to the nose 112 of the UUV 110. The UUV 110 is then typically shoved toward the stem 122 so the UUV 110 moves aft of the boat 120 while playing out the line 138, and then the line 138 is tightened by hand or with the winch 136 until the UUV 110 is pulled into contact with the alignment rails 134 and 135 and becomes aligned between the alignment rails 134 and 135 roughly parallel with the support rails 130 and 131. Then as the winch 136 draws the line 138, the winch 136 pulls the UUV 110 out of the water 150 and onto the support rails 130 and 131 in the boat 120.

The apparatus 100 includes a shock mitigation arrangement including shock isolators 140, 141, 142, 143, 144, 145, 146, and 147. The shock isolators 140, 141, 142, 143, 144, 145, 146, and 147 couple the support rails 130 and 131 to the boat 120 for absorbing shock arising when the boat 120 bounces over waves and turbulence of the body of water 150 during transport. A first set of four sets of the shock mitigation arrangement includes shock isolators 140 and 141 attached to the cross member 137, a second set includes shock isolators 142 and 143 attached to the fore end of the support rails 130 and 131, a third set includes shock isolators 144 and 145 attached to a middle of the support rails 130 and 131, and a fourth set includes shock isolators 146 and 147 attached to an aft end of the support rails 130 and 131.

In one embodiment, the shock isolators 140, 141, 142, 143, 144, 145, 146, and 147 are each a horizontally oriented coil spring with the ends of the coil spring attached to the hull decking of the boat 120, and the middle of each coil spring attached to a support rail 130 or 131. When the boat 120 is underway, the shock as the boat 120 strikes each wave primarily slows down the boat 120 with a horizontal shock, and secondarily lifts the boat 120 with a vertical shock. The horizontally oriented coil springs readily absorb the horizontal shock, and somewhat absorb the vertical shock to protect the UUV 110 from shock damage.

Figure 2:
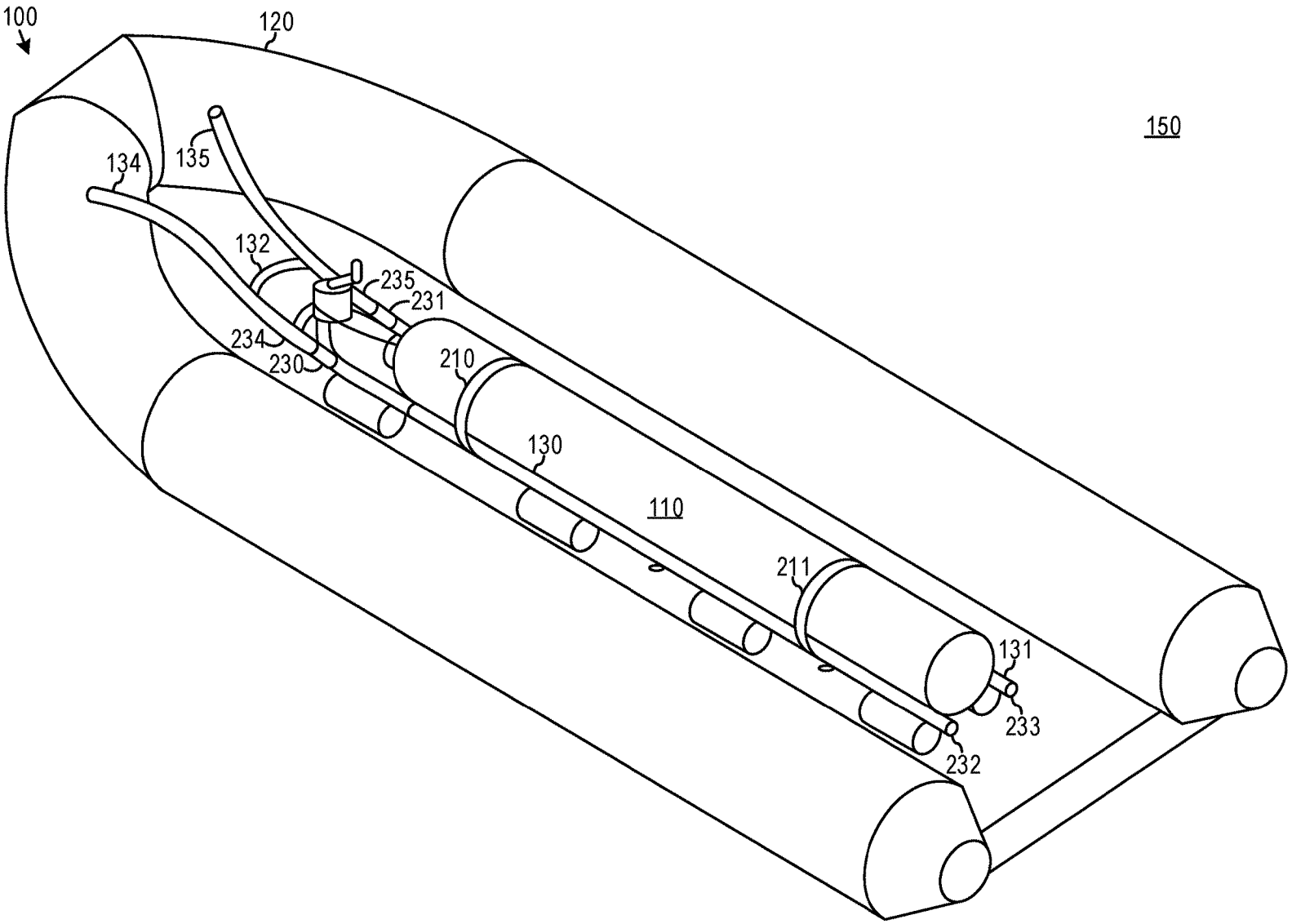
FIG. 2 is a perspective diagram showing the apparatus of FIG. 1 when the apparatus is in a storage state during transport in accordance with an embodiment of the invention.

FIG. 2 is a perspective diagram showing the apparatus 100 of FIG. 1 when the apparatus 100 is in a storage state during transport in accordance with an embodiment of the invention. During transport across the body of water 150, the support rails 130 and 131 secure the UUV 110 to the boat 120. Ratcheting tie-down straps 210 and 211 secure the UUV 110 to the support rails 130 and 131 for securing the UUV 110 to the boat 120.

Comparing FIG. 1 and FIG. 2, the ramp 132 is repositioned from the deployed state shown in FIG. 1 to the storage state shown in FIG. 2. Although in the deployed state the ramp 132 has its alignment rails 134 and 135 extending into the body of water 150 for launch and recovery as shown in FIG. 1, in the storage state the ramp 132 has its alignment rails 134 and 135 not extending into the body of water 150 for reducing drag from the ramp 132 during the transport across the body of water 150 as shown in FIG. 2.

A fore end on or adjacent the support rails 130 and 131 includes storage couplers 230 and 231, and an aft end of the support rails 130 and 131 includes deployed couplers 232 and 233. An end of the alignment rails 134 and 135 of the ramp 132 includes ramp couplers 234 and 235. In the storage state during the transport as shown in FIG. 2, the storage coupler 230 is attached to the ramp coupler 234 and the storage coupler 231 is attached to the ramp coupler 235. In the deployed state during the launch and during the recovery as shown in FIG. 1, the deployed coupler 232 is attached to the ramp coupler 234 and deployed coupler 233 is attached to the ramp coupler 235.

The support rails 130 and 131 are parallel rails for supporting the UUV 110 at a five o'clock portion and a seven o'clock portion of a cylindrical surface of the UUV 110, which cylindrical surface has a twelve o'clock portion upwards during the transport as shown in FIG. 2.

In one embodiment, the apparatus 100 includes a system for pushing the UUV 110 into the body of water 150 with the winch 136 during the launch. This launch system shown in FIG. 1 includes at least one launch coupler 240 and at least one reversing pulley 242 attached to respective support rails 130 and 131 toward an aft end of the support rails 130 and 131, and also an arrangement 244 of pulleys for disposing on the nose 112 of the UUV 110. After transport with the UUV 110 secured on the boat 120 as shown in FIG. 2, the line 138 is threaded through the reversing pulley 242 and through the arrangement 244 of pulleys cradling the nose 112 of the UUV 110, and then the carabiner 139 attached to the launch coupler 240. The arrangement 244 of pulleys prevents the line 138 from dragging across the surface of the UUV 110. The arrangement 244 of pulleys can include a diverting slot (not shown) for diverting the line 138 around the UUV 110 between the winch 136 and the reversing pulley 242; alternatively or in addition, a diverting pulley (not shown) is attached to the cross member 137 near or on the storage coupler 231.

It will be appreciated that the various pulleys are rollers, slots, eyes, or a combination thereof for passing the line 138 in various embodiments of the invention. For example, the diverting pulley (not shown) attached to the cross member 137 is a roller so that the line 138 is not impeded from winding across the full width of the winch 136. It will also be appreciated that the line 138 is a rope, a wire cable, or a strap in various embodiments of the invention.

The hand winch 136 draws the line 138 across the diverting slot and/or diverting pulley (not shown), around the reversing pulley 242, through the arrangement 244 of pulleys cradling the nose 112 of the UUV 110, to the launch coupler 240. This pulls the nose 112 of the UUV 110 towards the stern 122 for launching the UUV 110 from the storage state shown in FIG. 2 after removing ratcheting tie-down straps 210 and 211.

The arrangement 244 of pulleys provides a 2:1 mechanical advantage during launch as compared with recovery that does not use the arrangement 244 of pulleys. However in one embodiment, during recovery the arrangement 244 of pulleys is attached to the cross member 137 with the diverting slot centered between the support rails 130 and 131 so that the line 138 freely passes through the diverting slot of the arrangement 244 of pulleys. With this diverting slot sized to pass line 138 but not the carabiner 139 during launch and recovery, then the arrangement 244 of pulleys cannot ever become lost. The 2:1 mechanical advantage of arrangement 244 of pulleys offsets the friction in the various eyes, slots, and pulleys. The 2:1 mechanical advantage also helps overcome the high static friction of the UUV 110 after drying in storage on the pair of support rails 130 and 131.

The winch 136 has a limited capacity for winding the line 138. During recovery, the winch 136 winds up nearly all of the line 138. For launch, if the launch coupler 240 and the reversing pulley 242 are positioned at the aft end of the support rails 130 and 131, then the line 138 must have a length that is approximately three times the length of the UUV 110. Instead as shown in FIG. 1, the launch coupler 240 and the reversing pulley 242 are positioned at the middle of the support rails 130 and 131, so that required length of the line 138 is approximately 1.5 times the length of the UUV 110, which length of the line 138 is approximately the length needed for successful recovery of the UUV 110.

Although positioning the launch coupler 240 and the reversing pulley 242 as shown in FIG. 1 enables pushing the UUV 110 only half-way down the support rails 130 and 131 during launch, typically the nose 112 of the UUV 110 can be manually lifted from this half-way position and then the UUV 110 can be manually slid into the body of water 150. Alternatively, one or more additional sets of a launch coupler and a reversing pulley are positioned further aft along the support rails 130 and 131 so that the UUV 110 can be further pushed down the support rails 130 and 131 in stages without needing to increase the length of the line 138.

In another embodiment, omitted is the system for pushing the UUV 110 into the body of water 150 with the winch 136. Instead, the boat 120 is deflated during launch, such that water 150 fills the boat 120 and helps lift the UUV 110 off the support rails 130 and 131 and into the body of water 150. The boat is re-inflated before or after recovery.

Figure 3:
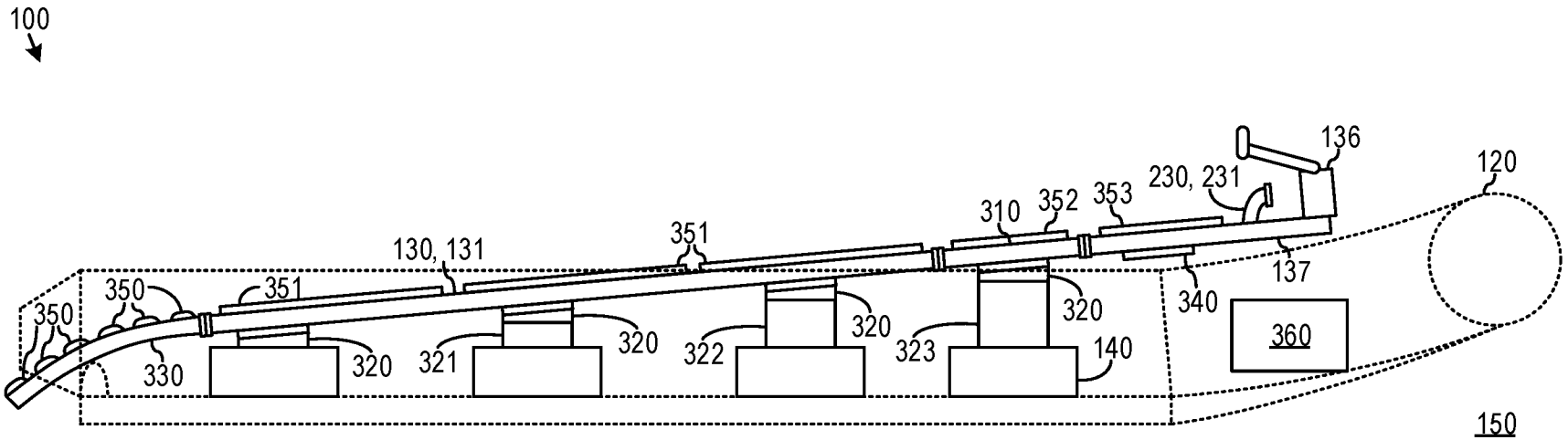
FIG. 3 is a side view showing the apparatus of FIG. 1 modified with an extension and tilted support rails for transport, launch, and recovery of a longer unmanned undersea vehicle (UUV) in accordance with an embodiment of the invention.

FIG. 3 is a side view showing the apparatus 100 of FIG. 1 modified with an extension 310 and tilted support rails 130 and 131 for transport, launch, and recovery of a longer unmanned undersea vehicle (UUV) in accordance with an embodiment of the invention. In this side view, the inflatable boat 120 is shown in dotted lines.

In the modification of FIG. 3, the same cross member 137 with winch 136 and the same pair of support rails 130 and 131 are used as in FIGS. 1 and 2, but an extension 310 is added to accommodate a longer UUV (not shown). With the extension 310 installed, the cross member 137 moves forward in the inflatable boat 120. When the inflatable boat 120 bounces over waves of the body of water 150 during the transport, the inflatable boat 120 can flex sufficiently for the hull decking of the inflatable boat 120 to strike the underside of the cross member 137. The UUV and the hull decking are potentially damaged when the hull decking of the boat 120 strikes the cross member 137. However, tilting the support rails 130 and 131 provides the clearance needed to deter the hull decking of the boat 120 from striking the cross member 137 when the extension 310 is installed.

Thus, the support rails 130 and 131 are tilted with a fore end of the support rails 130 and 131 higher than an aft end of the support rails 130 and 131 at an angle from zero to ten degrees relative to hull decking of the inflatable boat 120. To tilt the support rails 130 and 131, four wedges 320 and three spacers 321, 322, and 323 are installed whenever the extension 310 is installed. The ramp 330 either is the same as ramp 132 of FIGS. 1 and 2, or is a different ramp 330 adapted to the longer UUV. For example, the ramp 330 is curved in only one dimension without flaring, such that over the length of the alignment rails of the ramp 330, the same separation is maintained between the alignment rails of the ramp 330. In another embodiment, the ramp is a straight ramp with alignment rails that collinearly extend the support rails 130 and 131 into the body of water 150. During transport, the ramp 330 is attached to the storage couplers 230 and 231.

When the extension 310 is not installed, the wedges 320 and spacers 321, 322, and 323 are omitted, the cross member 137 is directly attached to the support rails 130 and 131, and the bracket 340 of the cross member 137 is directly attached to the shock isolator 140. An uninstalled extension 310 can be stored attached to the storage couplers 230 and 231 or stored in a customization kit 360.

The alignment rails of the ramp 330, the pair of support rails 130 and 131, the extension 310, and the cross member 137 include resilient bumpers 350, 351, 352, and 353 for limiting abrasion of the UUV during the transport, the launch, and the recovery. In one embodiment, the resilient bumpers 350, 351, 352, and 353 are a set of delrin bunks customized for transporting, launching, and recovering a particular type of UUV. For example, the resilient bumpers 350, 351, 352, and 353 are customized to support a non-cylindrical UUV or are customized with cutouts for sensors of the UUV that are especially sensitive to shock during transport. The resilient bumpers 350, 351, 352, and 353 in the set are interchangeable with other sets of resilient bumpers, each set of resilient bumpers customized to support a respective different type of unmanned undersea vehicle. A customization kit 360 includes the spare sets of resilient bumpers, and also the wedges 320 and spacers 321, 322, and 323 when the extension 310 is not installed.

Figure 4:
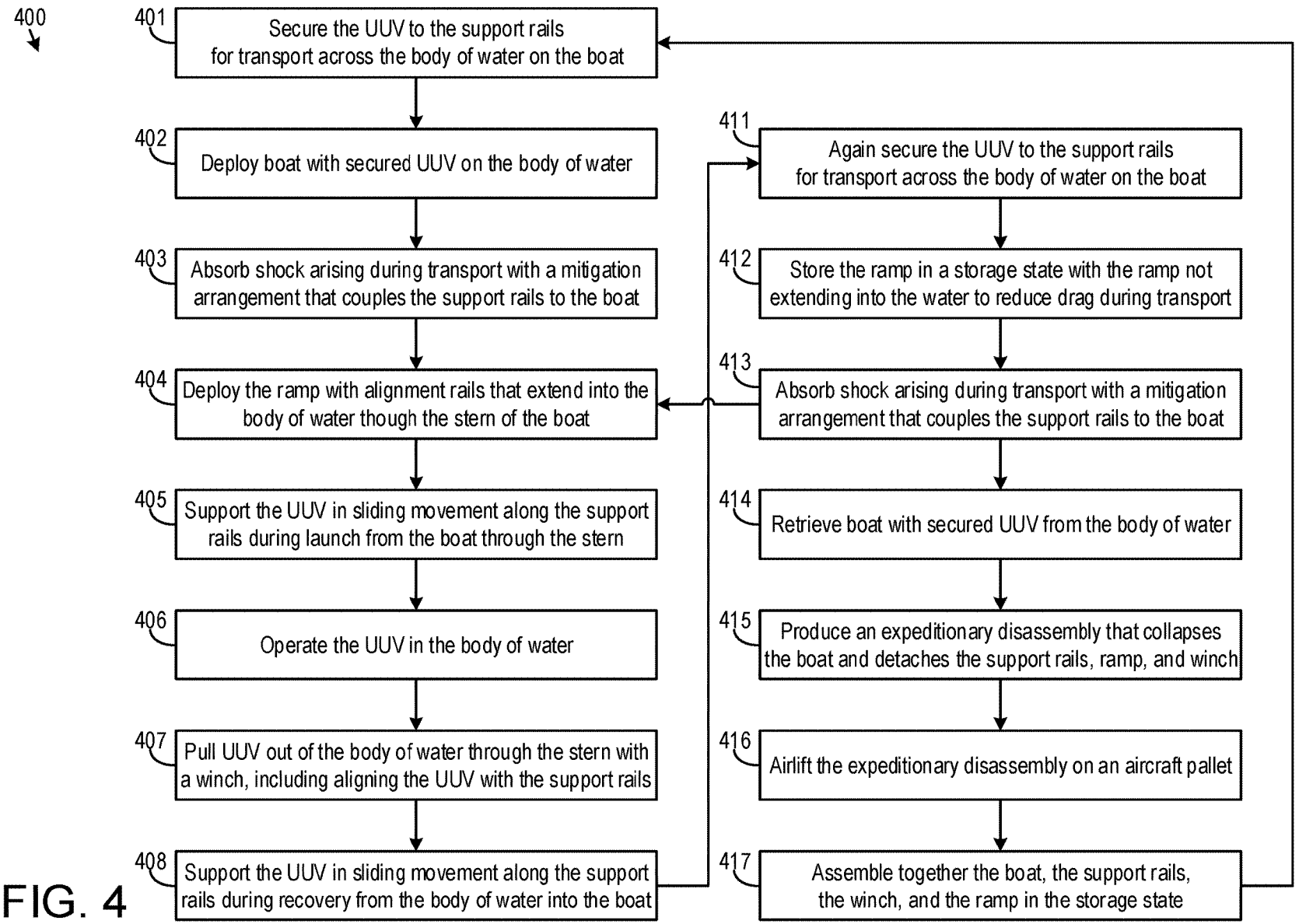
FIG. 4 is a flow diagram of a process for transport, launch, and recovery of an unmanned undersea vehicle (UUV) on a boat in accordance with an embodiment of the invention.

FIG. 4 is a flow diagram of a process 400 for transport, launch, and recovery of an unmanned undersea vehicle (UUV) on a boat in accordance with an embodiment of the invention. The transport includes steps 401 through 403 and steps 413 through 417. The launch includes steps 404 and 405. The recovery includes steps 407 through 412.

At step 401, the UUV is secured to a pair of support rails in preparation for transport across a body of water on the boat. Ratcheting tie-down straps are tightened to secure the UUV to the support rails. At step 402, the boat with the secured UUV is deployed on the body of water. For example, the boat with the secured UUV is hoisted with a davit from a trailer on the deck of a ship onto the body of water. At step 403, shock is absorbed that arises when the boat bounces over waves and turbulence of the body of water during the transport. The shock is absorbed with a shock mitigation arrangement that couples the support rails to the boat.

At step 404, a ramp is deployed that includes a pair of alignment rails. In this deployed state, the alignment rails extend the support rails into the body of water through a stern of the boat. Ratcheting tie-down straps are removed that secure the UUV to the support rails. At step 405, the UUV is supported in sliding movement along the support rails during the launch from the boat through the stem into the body of water.

At step 406, the UUV operates a designated mission in the body of water.

At step 407, the UUV is pulled out of the body of water through the stem with a winch during the recovery, including pulling the UUV into the alignment rails that align the UUV with the support rails. At step 408, the UUV is supported in sliding movement along the support rails during the recovery from the body of water onto the support rails in the boat. At step 411, the UUV is again secured to the pair of support rails in preparation for transport across a body of water on the boat. Ratcheting tie-down straps are tightened to secure the UUV to the support rails. At step 412, the ramp is stored in a storage state with the ramp not extending into the body of water to reduce drag from the ramp during the subsequent transport across the body of water.

At step 413, shock is again absorbed that arises when the boat bounces over waves and turbulence of the body of water during the transport. If this transport delivers the UUV to the origin of its next mission, then process 400 returns to step 404; otherwise, process 400 proceeds to step 414. At step 414, the boat with the secured UUV is retrieved from the body of water. For example, the boat with the secured UUV is hoisted with a davit from the body of water onto a trailer on the deck of a ship, and then the ratcheting the tie-down straps are disengaged and the davit removes the UUV from the boat on the trailer. At step 415, a disassembly is produced that collapses the boat and detaches the support rails, the ramp, and the winch from each other. The disassembly has a combined maximum length of 104 inches so that the disassembly including the boat is expeditionary to fit on a single aircraft pallet. At step 416, the expeditionary disassembly is airlifted on the aircraft pallet to a new location. At step 417, the expeditionary disassembly is assembled, with the ramp stored in the storage state. Process 400 then returns to step 401.

It will be appreciated that the example loops within process 400 can be iteratively repeated. After initial manufacture, process 400 begins at step 415 with the newly manufactured expeditionary disassembly. After assembly, the apparatus is readily man portable without the UUV.

From the above description of the Portable UUV Launch and Recovery Assembly, it is manifest that various techniques may be used for implementing the concepts of apparatus 100 and process 400 without departing from the scope of the claims. The described embodiments are to be considered in all respects as illustrative and not restrictive. The apparatus/method disclosed herein may be practiced in the absence of any element that is not specifically claimed and/or disclosed herein. It should also be understood that each of apparatus 100 and process 400 is not limited to the particular embodiments described herein, but is capable of many embodiments without departing from the scope of the claims.

We claim:

1. An apparatus for transport, launch, and recovery of an unmanned undersea vehicle (UUV) on a boat, the apparatus comprising:

a pair of support rails for securing the UUV to the boat during the transport across a body of water, and for supporting the UUV in sliding movement along the support rails during the launch from the boat into the body of water and during the recovery from the body of water onto the boat;

a ramp for extending the support rails into the body of water in a deployed state, the ramp including a pair of alignment rails for aligning the UUV with the support rails during the recovery from the body of water; and a winch for pulling the UUV out of the body of water during the recovery, the winch for pulling the UUV into the alignment rails and then onto the support rails in the boat during the recovery.

2. The apparatus of claim 1, wherein the support rails are parallel rails for supporting the UUV at a five o'clock portion and a seven o'clock portion of a cylindrical surface of the UUV, which cylindrical surface has a twelve o'clock portion upwards during the transport.

3. The apparatus of claim 1, wherein the support rails and the alignment rails include resilient bumpers for limiting abrasion of the UUV during the transport, the launch, and the recovery.

4. The apparatus of claim 3, wherein the resilient bumpers are in a set that is one of a plurality of sets of resilient bumpers, and the apparatus further comprises the plurality of sets of resilient bumpers, each set in the plurality adapted to support a respective type of a plurality of different types of unmanned undersea vehicles.

5. The apparatus of claim 1, wherein the alignment rails of the ramp are a pair of flaring curved rails that align the UUV with the support rails during the launch and during the recovery despite waves and turbulence of the body of water.

6. The apparatus of claim 1, wherein the ramp has the deployed state and a storage state, in the deployed state the ramp for extending into the body of water during the launch and the recovery, and the ramp not extending into the body of water in the storage state for reducing drag from the ramp during the transport across the body of water.

7. The apparatus of claim 6, wherein a fore end on or adjacent the support rails includes a first and second coupler and an aft end of the support rails includes a third and fourth coupler, and an end of the alignment rails of the ramp includes a fifth and sixth coupler, the first coupler attached to the fifth coupler and the second coupler attached to the sixth coupler in the storage state during the transport, and the third coupler attached to the fifth coupler and the fourth coupler attached to the sixth coupler in the deployed state during the launch and during the recovery.

8. The apparatus of claim 1, wherein the winch is disposed on a cross member that bridges between the support rails at a fore end of the support rails.

9. The apparatus of claim 1, wherein the winch is a hand winch drawing a line terminating at a carabiner for attaching to a nose of the UUV for pulling the UUV out of the body of water and onto the boat during the recovery.

10. The apparatus of claim 9, further comprising:

at least one coupler and at least one reversing pulley attached to respective ones of the support rails toward an aft end of the support rails; and an arrangement of pulleys for disposing on the nose of the UUV, wherein the hand winch draws the line for pushing the UUV into the body of water during the launch with the carabiner attached to the coupler and with the line threaded through the reversing pulley and through the arrangement of pulleys cradling the nose of the UUV.

11. The apparatus of claim 1, further comprising the boat that is an inflatable boat without a transom so that, in the deployed state during the launch and the recovery, the alignment rails of the ramp extend through a stem of the inflatable boat.

12. The apparatus of claim 11, wherein the support rails are tilted with a fore end of the support rails higher than an aft end of the support rails at an angle of zero to ten degrees relative to hull decking of the inflatable boat.

13. The apparatus of claim 11, wherein the inflatable boat is collapsible and the support rails, the ramp, and the winch are detachable from each other to produce a disassembly with a combined maximum length of 104 inches so that the disassembly including the boat is expeditionary to fit on a single aircraft pallet.

14. The apparatus of claim 11, further comprising a shock mitigation arrangement coupling the support rails to the boat for absorbing shock arising when the boat bounces over waves and turbulence of the body of water during the transport.

15. The apparatus of claim 14, wherein the shock mitigation arrangement includes four sets of shock isolators including a first set attached to a cross member, which carries the winch and bridges between the support rails at a fore end of the support rails, a second set attached to the fore end of the support rails, a third set attached to a middle of the support rails, and a fourth set attached to an aft end of the support rails.

16. The apparatus of claim 1, further comprising a shock mitigation arrangement for coupling the support rails to the boat and for absorbing shock arising when the boat bounces over waves and turbulence of the body of water during the transport.

17. A method for transport, launch, and recovery of an unmanned undersea vehicle (UUV) on a boat, the method comprising:

securing the UUV to a pair of support rails during the transport across a body of water on the boat;

deploying a ramp including a pair of alignment rails, wherein in a deployed state the alignment rails extend the support rails into the body of water through a stern of the boat;

supporting the UUV in sliding movement along the support rails during the launch from the boat through the stem into the body of water;

pulling the UUV out of the body of water through the stern with a winch during the recovery, including pulling the UUV into the alignment rails that align the UUV with the support rails; and supporting the UUV in sliding movement along the support rails during the recovery from the body of water onto the support rails in the boat.

18. The method of claim 17, further comprising:

storing the ramp in a storage state with the ramp not extending into the body of water to reduce drag from the ramp during the transport across the body of water.

19. The method of claim 17, further comprising:

absorbing shock arising when the boat bounces over waves and turbulence of the body of water during the transport, including absorbing the shock with a shock mitigation arrangement that couples the support rails to the boat.

20. The method of claim 17, further comprising:

producing a disassembly that collapses the boat and detaches the support rails, the ramp, and the winch from each other, the disassembly having a combined maximum length of 104 inches so that the disassembly including the boat is expeditionary to fit on a single aircraft pallet.

* * * * *